US009936752B2

(12) United States Patent
Calvert et al.

(10) Patent No.: US 9,936,752 B2
(45) Date of Patent: Apr. 10, 2018

(54) CLOTHING PERSONALIZATION TECHNOLOGIES

(71) Applicant: SwitchSwap, LLC, Inman, SC (US)

(72) Inventors: Christin Littlejohn Calvert, Inman, SC (US); Amber Ezell Scott, Atlanta, GA (US)

(73) Assignee: SwitchSwap, LLC, Inman, SC (US)

( * ) Notice: Subject to any disclaimer, the term of this patent is extended or adjusted under 35 U.S.C. 154(b) by 0 days.

(21) Appl. No.: 14/962,562

(22) Filed: Dec. 8, 2015

(65) Prior Publication Data

US 2016/0165983 A1 Jun. 16, 2016

Related U.S. Application Data

(60) Provisional application No. 62/089,911, filed on Dec. 10, 2014.

(51) Int. Cl.

| | |
|---|---|
| ***A41F 1/00*** | (2006.01) |
| ***A44C 3/00*** | (2006.01) |
| *A44C 15/00* | (2006.01) |

(52) U.S. Cl.

CPC ..... *A41F 1/002* (2013.01); *A44C 3/001* (2013.01); *A44C 15/004* (2013.01)

(58) Field of Classification Search

CPC ..... A41F 1/002; A44D 2203/00; A41D 27/08; H01F 7/0215; Y10T 24/32

USPC ..... 24/303

See application file for complete search history.

(56) References Cited

U.S. PATENT DOCUMENTS

| | | | | | |
|---|---|---|---|---|---|
| 4,236,331 | A * | 12/1980 | Mattson | G09F 7/00 | 40/1.5 |
| 5,369,899 | A * | 12/1994 | Reeves | A44C 3/001 | 24/303 |
| 5,604,960 | A * | 2/1997 | Good | A41F 1/002 | 24/303 |
| 5,682,653 | A * | 11/1997 | Berglof | G09F 1/10 | 224/183 |
| 5,740,557 | A * | 4/1998 | Reid | A42B 1/248 | 2/195.1 |
| 6,035,449 | A * | 3/2000 | Galler | A41D 27/08 | 2/247 |
| 6,146,324 | A * | 11/2000 | Engel | A61N 2/008 | 600/15 |
| 6,301,754 | B1 * | 10/2001 | Grunberger | A41F 1/002 | 24/303 |
| 7,194,828 | B2 * | 3/2007 | Peterson | A44C 3/001 | 40/1.5 |
| 7,404,215 | B2 * | 7/2008 | Allen | A41D 27/12 | 2/231 |
| 7,712,150 | B2 * | 5/2010 | Pardillo | A41D 13/065 | 2/16 |

(Continued)

*Primary Examiner* — Robert Sandy
*Assistant Examiner* — Rowland Do
(74) *Attorney, Agent, or Firm* — Lee & Hayes, PLLC

(57) ABSTRACT

A personalization attachment mechanism is disclosed herein. The personalization attachment mechanism, in some examples, includes an outer layer and an inner layer. The outer layer is configured to be shown and worn on the outside of clothing, bags, apparel, and other accessories. The outer layer can include indicia, markings, designs, decorations and the like. The outer layer is removably attachable to the inner layer. The inner is configured to be worn on the inside of clothing, bags, apparel, and other accessories.

5 Claims, 6 Drawing Sheets

(56) References Cited

U.S. PATENT DOCUMENTS

| | | | | |
|---|---|---|---|---|
| 8,314,672 | B2 * | 11/2012 | Fullerton | G09F 7/04 24/303 |
| 8,621,668 | B1 * | 1/2014 | Nolz | A42B 5/00 2/171.4 |
| 9,320,328 | B1 * | 4/2016 | Sinclair | A44C 1/00 |
| 2005/0102802 | A1 * | 5/2005 | Sitbon | A41F 1/002 24/303 |
| 2006/0032026 | A1 * | 2/2006 | Schoening | A41D 25/003 24/66.1 |
| 2007/0028367 | A1 * | 2/2007 | Allen | A41D 27/12 2/244 |
| 2009/0289090 | A1 * | 11/2009 | Fullerton | A45F 5/02 224/183 |
| 2010/0071110 | A1 * | 3/2010 | Stevens | A41D 27/20 2/69 |
| 2010/0269239 | A1 * | 10/2010 | Kulp | A41D 27/08 2/69 |
| 2011/0083254 | A1 * | 4/2011 | Trutna | A41F 1/002 2/326 |
| 2011/0247201 | A1 * | 10/2011 | d'Auriac | A41D 27/08 29/700 |
| 2012/0005809 | A1 * | 1/2012 | Johnson | A42B 1/248 2/209.13 |
| 2012/0079688 | A1 * | 4/2012 | Bunting | A41F 1/002 24/303 |
| 2012/0216374 | A1 * | 8/2012 | Manuello | A41F 1/002 24/303 |
| 2014/0196330 | A1 * | 7/2014 | Cook | A44C 3/004 40/594 |

* cited by examiner

CLOTHING PERSONALIZATION TECHNOLOGIES

CROSS REFERENCE TO RELATED APPLICATIONS

This application claims the benefit of U.S. Provisional Patent Application No. 62/089,911 filed Dec. 10, 2014 entitled "Clothing Personalization Technologies," which is expressly incorporated herein by reference in its entirety.

BACKGROUND

Currently, embroidery and appliquéing are two major techniques that are used to provide ornamentation and style to many fashions, especially in the children's clothing market. These are widely used to make the clothing more personal and to be used for specific holidays or occasions. Another trend that adds design and personalization to children's clothing, women's wear, and accessories such as purses, book bags, hats, etc. is to add a monogram. A monogram typically includes a person's initials or name, whether it is three initials or one.

It is with respect to these and other considerations that the disclosure made herein is presented.

SUMMARY

A personalization attachment mechanism is disclosed herein. The personalization attachment mechanism, in some examples, includes an outer layer and an inner layer. The outer layer is configured to be shown and worn on the outside of clothing, bags, apparel, and other accessories. The outer layer can include indicia, markings, designs, decorations and the like. The outer layer is removably attachable to the inner layer. The inner is configured to be worn on the inside of clothing, bags, apparel, and other accessories.

In some examples, the outer layer is removably attachable to the inner layer through the use of magnetic attachment devices. In some examples, the magnetic attachment devices are attached between an upper layer and a lower layer of each of the outer and inner layers. The upper layer and lower layer may be constructed of various forms of cloth, polymers, and other appropriate materials.

These and various other features as well as advantages will be apparent from a reading of the following detailed description and a review of the associated drawings.

DETAILED DESCRIPTION OF EMBODIMENTS

Various configurations of the presently disclosed subject matter represents an advance over conventional technologies. The life of clothing can be increased, made more versatile and more affordable to have cute, festive, or personalized clothing without being limited by permanence. In some configurations, personalization attachment mechanisms according to some examples include movable monograms and appliqués that allow a user to change to look of a garment and a variety of accessories with a quick switch and click. Personalization attachment mechanisms according to some examples vary in shape and size and can be customized to fit a user's style. In some configurations, Personalization attachment mechanisms according to some examples range from 2-5 inches in diameter. Personalization attachment mechanisms according to some examples can be circular, rectangular, and square. Personalization attachment mechanisms according to some examples can have a variety of edging such as ruffles, satin stitching, ric rac, ziz zag stitch, ribbons, surging, or raggy edge. In some configurations, Personalization attachment mechanisms according to some examples can mirror or appear as pockets on clothing. The fabric can vary from season to season. Personalization attachment mechanisms according to some examples can be appliquéd with various designs. The fabric, thread and design used can vary based on the user's taste. Some monograms may even be made using acrylic and vinyl lettering versus thread. It should be understood, however, that the presently disclosed subject matter is not limited to any particular size, shape, fabric, or other configuration.

In some examples, the magnets are neodymium magnets. These magnets can be lead free and safe for children and adults, even those who wear a pacemaker. The magnets can have a plastic coating around the magnet, which can be a secure way to sew a magnet into any type of clothing or garment. Personalization attachment mechanisms according to some examples can also affix a cotton backing over the magnets in order to reduce the chances of a loose magnet. If the magnet were to become detached from the plastic, it would be trapped inside the personalization attachment mechanisms according to some examples itself and remain there.

Figure 1:
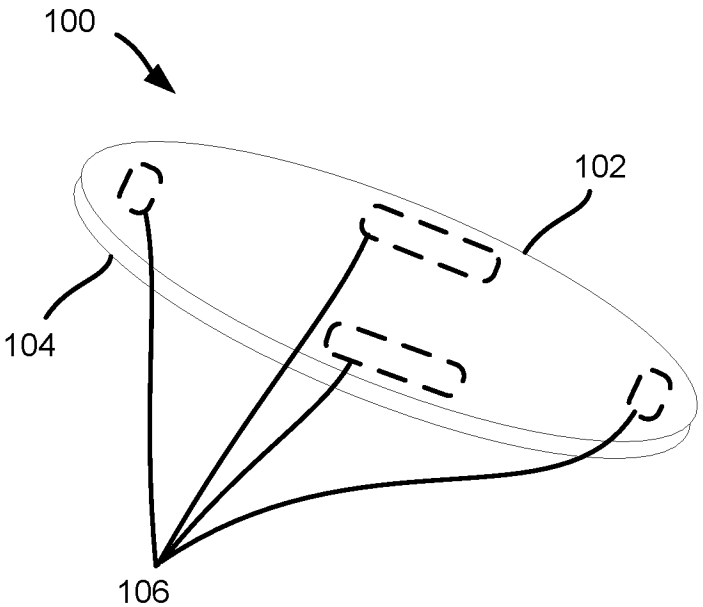
FIG. 1 a diagram showing a perspective view of personalization attachment mechanism according to at least one embodiment disclosed herein.

Turning now to the figures, FIG. 1 a diagram showing a perspective view of personalization attachment mechanism 100 according to at least one embodiment disclosed herein. The personalization attachment mechanism includes an outer layer 102 and an inner layer 104. The outer layer 102 can be configured to include various designs, indicia, or other marking. The outer layer 102 is configured to be worn and displayed on the outside of a garment or accessory. The inner layer 104 is configured to be worn on the inside of a garment or accessory.

The outer layer 102 is removably attached to the inner layer 104 using magnetic attachments 106 (described in more detail below). The magnetic attachments 106 allow for the affixing and removing of the personalization attachment mechanism 100 to various garments or accessories. It should be understood that the outer layer 102 is interchangeable among other outer layers (not shown) so that the personalization attachment mechanism 100 can be used with different outer layers 102.

Figure 2:
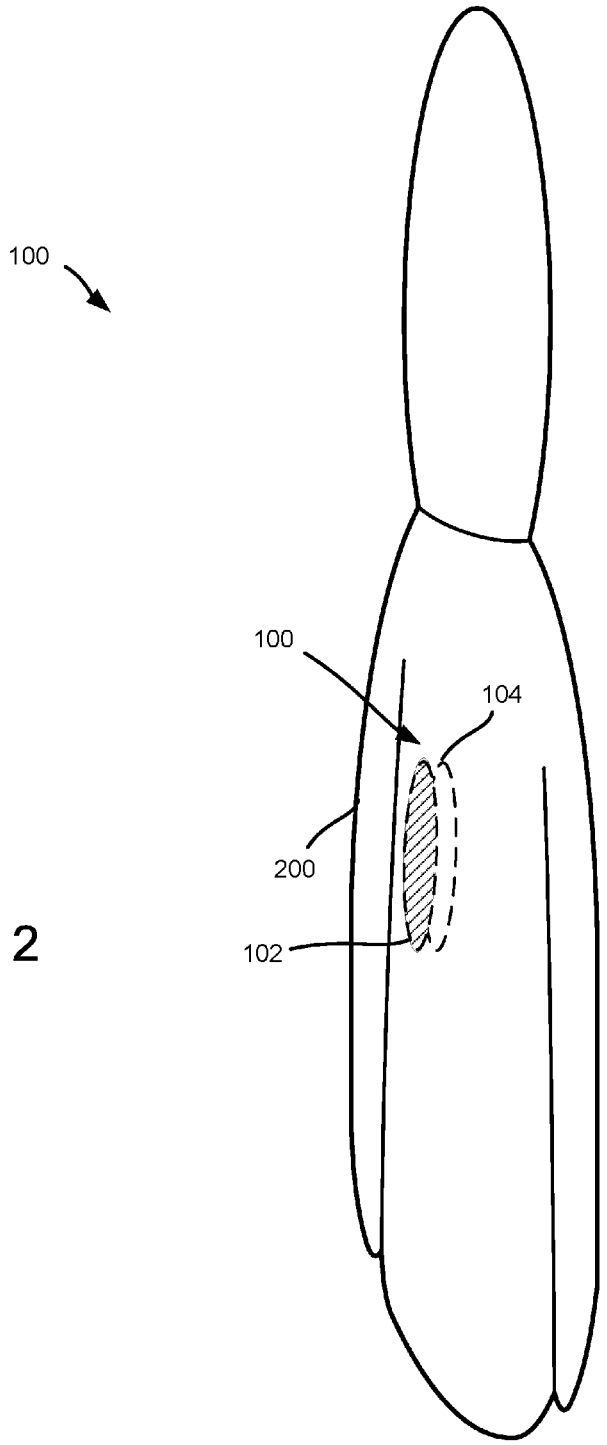
FIG. 2 is a diagram showing a personalization attachment mechanism installed on a shirt according to at least one embodiment disclosed herein.

FIG. 2 is a diagram showing the personalization attachment mechanism 100 installed on a shirt 200 according to at least one embodiment disclosed herein. As illustrated, the outer layer 102 is disposed on an outer surface of the shirt 200 and the inner layer 104 is disposed on an inner surface of the shirt 200 so that the outer layer 102 is visible outside of the shirt 200 and the inner layer 104 is not readily visible outside of the shirt 200. The personalization attachment mechanism can be moved to various locations of the shirt 200 using the magnetic attachments 106 of FIG. 1.

Figure 3:
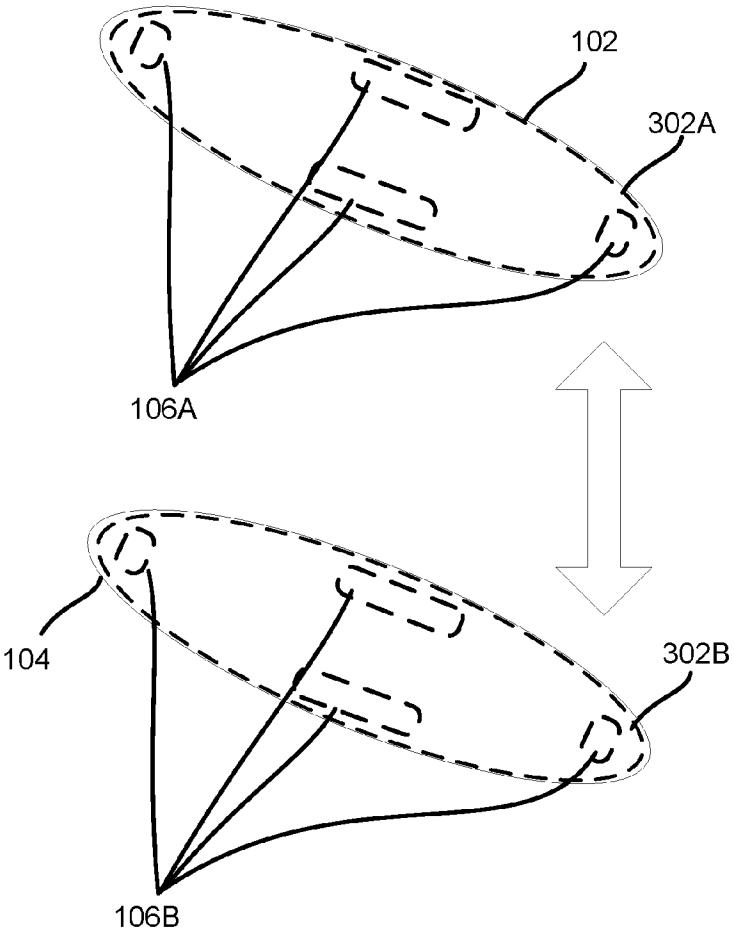
FIG. 3 is an exploded, perspective view of a personalization attachment mechanism according to at least one embodiment disclosed herein.

FIG. 3 is an exploded, perspective view of the personalization attachment mechanism 100 according to at least one embodiment disclosed herein. As shown in FIG. 3, the outer layer 102 and the inner layer 104 include magnetic attachments 106A and 106B, respectively, disposed therein. As discussed above, the magnetic attachments 106A and 106B are designed to cooperatively, removably couple the outer layer 102 to the inner layer 104. The outer layer 102 and the inner layer 104 include stitching 302A and 302B, respectively. The stitching is a result of affixing two layers of material together to encapsulate the magnetic attachments 106A and 106B within the two layers, described in more detail in FIG. 4.

Figure 4:
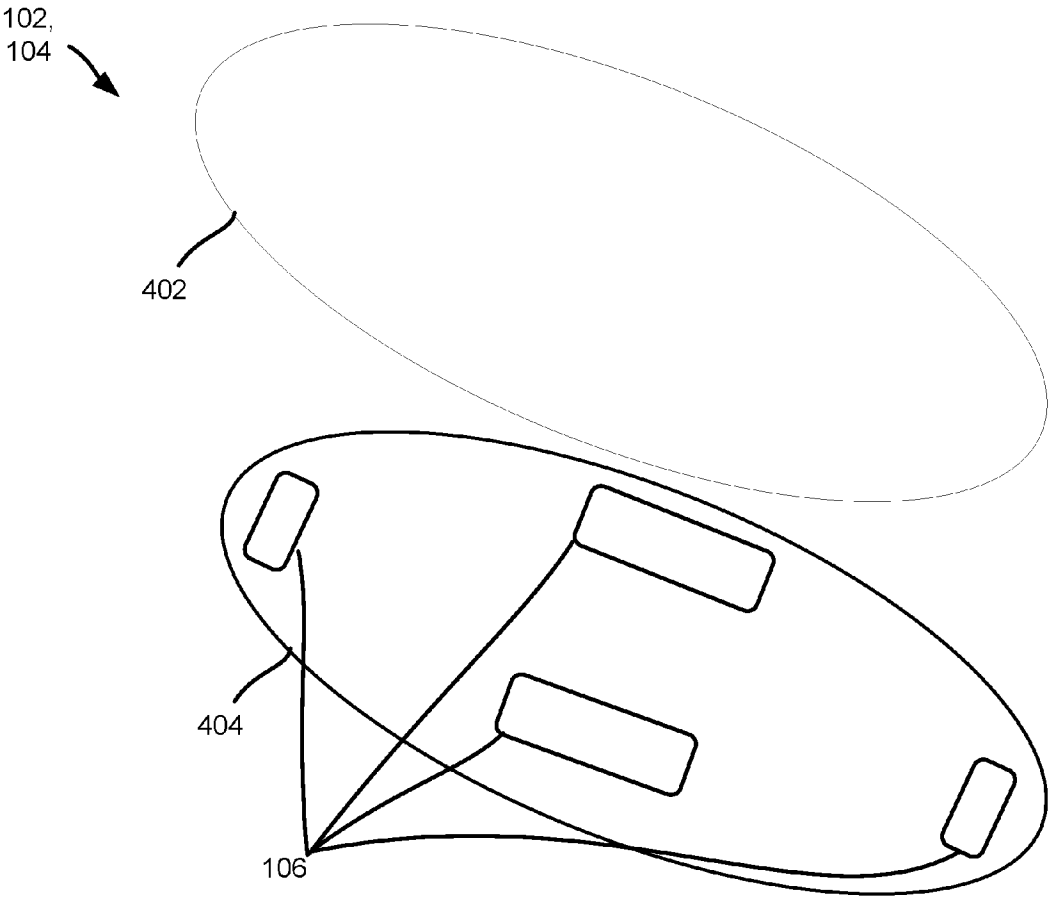
FIG. 4 is an exploded, perspective view of an outer or inner layer of a personalization attachment mechanism according to at least one embodiment disclosed herein.

FIG. 4 is an exploded, perspective view of the outer layer 102 or the inner layer 104 of the personalization attachment mechanism 100 according to at least one embodiment disclosed herein. As shown in FIG. 4, the outer layer 102 or the inner layer 104 includes an upper layer 402 and a lower layer 404. The outer layer 102 or the inner layer 104 also includes magnetic attachments 106.

The magnetic attachments 106 can be affixed to the upper layer 402 or the lower layer 404 using various affixing methods. For example, and not by way of limitation, the magnetic attachments 106 can be affixed using liquids such as glues or epoxies, can mechanically affixed by stitching, and other methods. The upper layer 402 can be affixed to the lower layer 404 by stitching the upper layer 402 to the lower layer 404. The magnetic attachments 106 can vary in size, number, and placement, an example of which is provided in FIG. 5.

Figure 5:
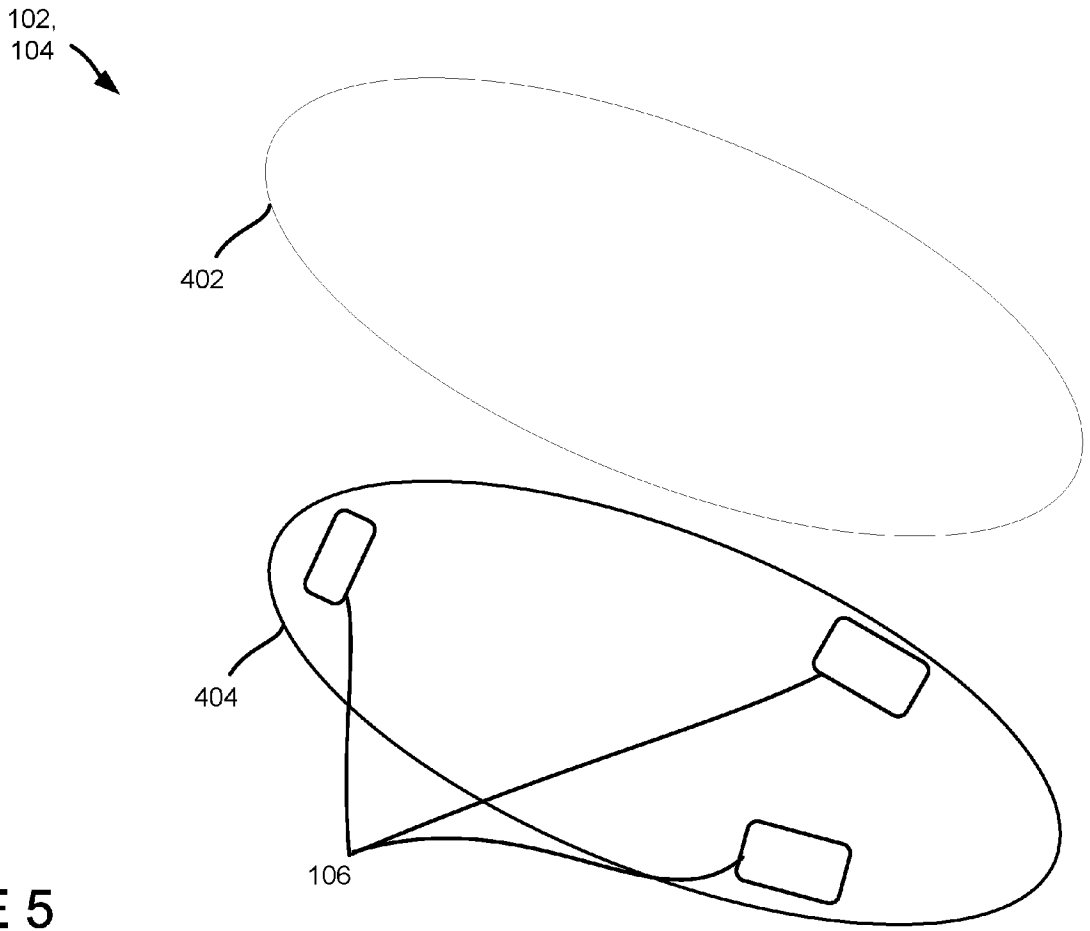
FIG. 5 is an exploded, perspective view of an outer or inner layer of a personalization attachment mechanism showing an alternate magnetic configuration according to at least one embodiment disclosed herein.

FIG. 5 is an exploded, perspective view of the outer layer 102 or the inner layer 104 of a personalization attachment mechanism 100 showing an alternate magnetic configuration according to at least one embodiment disclosed herein. As shown in FIG. 5, the magnetic attachments 106 are three in number and are disposed in a triangular pattern. The presently disclosed subject matter includes other numbers and locations.

Figure 6:
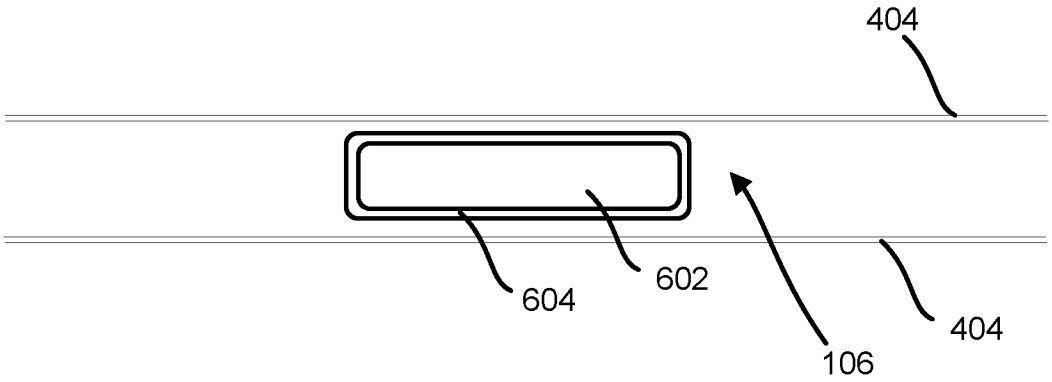
FIG. 6 is a side view of an outer or inner layer of a personalization attachment mechanism showing an alternate magnet according to at least one embodiment disclosed herein.

FIG. 6 is a side view showing an alternate magnet attachment 106 according to at least one embodiment disclosed herein. In FIG. 6, the magnetic attachment 106 includes an inner magnetic core 602 and an outer plastic shell 604 disposed least partially around the outer surface of the magnetic core 602. As mentioned above, a personalization attachment mechanism may be used in conjunction with infant or toddler clothing. In some instances, a baby may place the personalization attachment mechanism in its mouth. In some examples, the plastic shell 604 may be various plastics or polymers that are resistant to saliva. In further examples, the plastic shell 604 may be various plastics or polymers that are non-toxic if ingested.

The subject matter described above is provided by way of illustration only and should not be construed as limiting. Various modifications and changes may be made to the subject matter described herein without following the example embodiments and applications illustrated and described, and without departing from the true spirit and scope of the presently disclosed subject matter.

What is claimed is:

1. A personalization attachment system, comprising:

a garment;

a removably affixable outer layer removably affixable to the outside of the garment, the outer layer comprising a first cloth including a first plurality of magnetic attachments, and a removably affixable inner layer removably affixable to the inside of the garment, the inner layer comprising a second cloth, wherein the second cloth is separate from the first cloth, and wherein the inner layer is removably attachable to the outer layer and the garment, the inner layer including a second plurality of magnetic attachments, wherein the first plurality of magnetic attachments are configured to be magnetically coupled to the second plurality of magnetic attachments to removably affix the outer layer to the inner layer for removably affixing the personalization attachment system to the garment, wherein the first plurality of magnetic attachments and the second plurality of magnetic attachments allow for affixing and removing of the removably affixable outside layer at various locations of the garment.

2. The personalization attachment system of claim 1, wherein the outer layer comprises an upper layer and a lower layer, whereby the first plurality of magnetic attachments are affixed between the upper layer and the lower layer.

3. The personalization attachment system of claim 1, wherein the inner layer comprises an upper layer and a lower layer, whereby the second plurality of magnetic attachments are affixed between the upper layer and the lower layer.

4. The personalization attachment system of claim 1, wherein the first plurality of magnetic attachments or the second plurality of magnetic attachments comprises a magnetic core and an outer plastic shell.

5. The personalization attachment system of claim 1, wherein the outer layer comprises marking or indicia.

* * * * *